US007208251B2

(12) United States Patent
Egusa et al.

(10) Patent No.: US 7,208,251 B2
(45) **Date of Patent: *Apr. 24, 2007**

(54) METHOD FOR PRODUCING IMAGE-RECORDED MEDIUM, IMAGE FORMING APPARATUS AND IMAGE-RECORDED MEDIUM

(75) Inventors: Naoyuki Egusa, Ashigarakami-gun (JP); Tetsuro Kodera, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 293 days.

This patent is subject to a terminal disclaimer.

(21) Appl. No.: 10/661,498

(22) Filed: Sep. 15, 2003

(65) Prior Publication Data

US 2004/0081901 A1 Apr. 29, 2004

(30) Foreign Application Priority Data

Sep. 20, 2002 (JP) ..... 2002-276024
Aug. 6, 2003 (JP) ..... 2003-287429

(51) Int. Cl.
*G03G 13/01* (2006.01)
*G03G 13/20* (2006.01)

(52) U.S. Cl. ..... 430/45; 430/124

(58) Field of Classification Search ..... 430/45, 430/47, 97, 124; 399/341, 342, 321, 336
See application file for complete search history.

(56) References Cited

U.S. PATENT DOCUMENTS

| | | | | |
|---|---|---|---|---|
| 5,281,504 | A | 1/1994 | Kanbayashi et al. | |
| 5,327,201 | A * | 7/1994 | Coleman et al. | 399/342 |
| 5,784,679 | A | 7/1998 | Schlueter, Jr. et al. | |
| 6,985,691 | B2 * | 1/2006 | Kodera et al. | 399/341 |
| 2003/0043108 | A1 * | 3/2003 | Iwase et al. | 345/107 |

FOREIGN PATENT DOCUMENTS

JP A 09-171278 6/1997

* cited by examiner

*Primary Examiner*—Janis L. Dote
(74) *Attorney, Agent, or Firm*—Oliff & Berridge, PLC

(57) ABSTRACT

The present invention relates to a method for producing an image-recorded medium on the surface of a transparent substrate. The image-recorded medium comprises a fixed image formed electrographically, and the fixed image is laminated on the image-recorded medium. The production method comprises the steps of forming toner layers by laminating a plurality of toner layers on the surface of the substrate electrographically, temporarily fixing the plural toner layers, and laminating the temporarily fixed image with a laminate film.

14 Claims, 4 Drawing Sheets

METHOD FOR PRODUCING IMAGE-RECORDED MEDIUM, IMAGE FORMING APPARATUS AND IMAGE-RECORDED MEDIUM

CROSS-REFERENCE TO RELATED APPLICATION

This application claims priority under 35 USC 119 from Japanese patent Application Nos. 2002-276024 and 2003-287429, the disclosures of which are incorporated by reference herein.

BACKGROUND OF THE INVENTION

1. Field of the Invention

The present invention relates to a method for producing an image-recorded medium on which recorded images visible with both reflection light and transmission light are formed, and an image-recorded medium. In particular, the invention relates to a method for producing an image-recorded medium capable of maintaining highly reliable recorded images thereon and an image forming apparatus used for the method, and an image-recorded medium produced by the method and the apparatus.

2. Description of the Related Art

With recent developments of image forming technologies, methods for cheaply forming a large quantity of images having the same quality by employing various printing methods such as intaglio printing, letter-press printing, planographic printing, gravure printing and screen printing, have been known in the art.

For example, automobile meter panels are required to have both characteristics of light screening property and light transmitting property, and the screen printing has been employed from the technical point of view.

Recently, production of the automobile meter panels by applying electrophotographic technologies, has been attempted. By applying the electrophotographic technologies, the preparation and management of screen meshes, which have been required in screen printing, becomes unnecessary; moreover, minor changes of the meter panel can be easily made by changing electronic information, which largely reduces production cost in small lot production; further, repetition of processes such as printing and drying becomes unnecessary, which largely improves productivity.

With respect to laminates obtained by laminating recorded members such as identification cards and other cards with a transparent resin film, electrophotographic copy machines that produce and laminate the recorded medium electrographically are proposed (for example Japanese Patent Application Laid-Open (JP-A) No. 9-171278)).

In general, recorded images having both characteristics of screening and transmitting lights are required to have a proportion of acceptable products of almost 100% from the view point of mass production. However, complete light screening property cannot be attained by direct application of conventional electrophotographic technologies: many light transmitting holes called pin-holes are generated when electrophotographic technologies are employed. Accordingly, such high proportion of acceptable products cannot be obtained by conventional electrophotography.

For solving these problems, the following two countermeasures are essential for applying the electrophotographic process:

(1) when images are recorded by laminating four toner layers, at least two of the layers are composed of black toners; and (2) the transferred mass per area (TMA) of toner at light screening portions are at least 2.1 mg/cm$^2$.

A light screening ratio having a transmission density of 3.5 or more may be achieved by the two countermeasures. However, if the countermeasures are employed in usual electrophotographic systems, sufficient image quality cannot be obtained: the TMA twice as high as that of conventional systems causes problems such as image breaking caused by transfer failures or blisters (foaming in the fixing process). In other words, these transfer failures and blisters cause defects called pin-holes when the recorded image is evaluated with the transmission light.

For example, meter panels equipped in an automobile are required to have long-term reliability in an environment where the temperature in a cabin in midsummer is supposed to be 80 to 100° C. Since this temperature is higher than the glass transition point of the toner, the toner is fluidized by heat, so that the recorded images can no longer kept intact.

SUMMARY OF THE INVENTION

Accordingly, the object of the present invention is to solve the technical problems described above.

More specifically, an object of the invention is to provide a method for producing an image-recorded medium capable of maintaining a highly reliable recorded image thereon, an image forming apparatus used for the image-recorded medium, and an image-recorded medium produced by the method and the apparatus, wherein the image is required to have both characteristics of light screening property and light transmitting property as in an automobile meter panel, and free from deterioration of the recorded image even in a high temperature environment.

The objects above are attained by the following aspects of the present invention.

The first aspect of the present invention provides a method (A) for producing an image-recorded medium on the surface of a transparent substrate, the image-recorded medium comprising a fixed image formed electrographically, and the fixed image being laminated on the image-recorded medium, the method comprising: forming toner layers by laminating a plurality of toner layers on the surface of the substrate electrographically; temporarily fixing the plural toner layers; and laminating the temporarily fixed image with a laminate film.

The second aspect of the invention provides the method (A) for producing the image-recorded medium, wherein a toner layer having a color K (black) is developed twice in forming the toner layers.

The third aspect of the invention provides the method (A) for producing the image-recorded medium, wherein a white toner layer is formed at the uppermost layer of the laminated plural toner layers in forming the toner layers.

The fourth aspect of the invention is to provide the method (A) for producing the image-recorded medium, wherein a developer used in the step for forming the toner layers includes a toner and carrier, and the proportion of the mass of the toner to the sum of the mass of the toner and mass of the carrier is in the range of 2 to 12%.

The fifth aspect of the invention provides the method (A) for producing the image-recorded medium, wherein the fixing temperature T1 in the fixing step is in the range of 100 to 140° C.

The sixth aspect of the invention provides a method (B) for producing an image-recorded medium on the surface of a transparent substrate, the image-recorded medium comprising a fixed image formed electrographically, and the fixed image being laminated on the image-recorded medium, the method comprising: forming toner layers by laminating a plurality of toner layers on the surface of the substrate electrographically; temporarily fixing the plural toner layers by primary fixing, and converting the temporarily fixed image to a fixed image by secondary fixing; and laminating the fixed image with a laminate film.

The seventh aspect of the invention provides the method (B) for producing an image-recorded medium, wherein a toner layer having a color K (black) is developed twice in forming the toner layers.

The eighth aspect of the invention provides the method (B) for producing the image-recorded medium, wherein a white toner layer is formed at the uppermost layer of the laminated plural toner layers in forming the toner layers.

The ninth aspect of the invention provides the method (B) for producing the image-recorded medium, wherein the developer used in the step for forming the toner layers includes a toner and carrier, and the proportion of the mass of the toner to the sum of the mass of the toner and mass of the carrier is in the range of 2 to 12%.

The tenth aspect of the invention provides the method (B) for producing the image-recorded medium, wherein the fixing temperature T1 in the primary fixing is in the range of 100 to 140° C.

The eleventh aspect of the invention provides the method (B) for producing the image-recorded medium, wherein the fixing temperature T2 in the secondary fixing is in the range of 100 to 170° C.

The twelfth aspect of the invention provides the method (B) for producing the image-recorded medium, wherein the secondary fixing is carried out for 1 to 60 minutes.

The thirteenth aspect of the invention provides the method (B) for producing the image-recorded medium, wherein the secondary fixing is carried out in a non-contact state.

The fourteenth aspect of the invention provides an image forming apparatus used in the method (A) for producing the image-recorded medium, the apparatus comprising development means for forming a plurality of toner images in response to image information, transfer means for laminating the plural toner images on the surface of a substrate as a plurality of toner layers, and fixing means for temporarily fixing the laminated plural toner layers.

The fifteenth aspect of the invention provides an image forming apparatus used in the method (B) for producing the image-recorded medium, the apparatus comprising development means for forming a plurality of toner images in response to image information, transfer means for laminating the plural toner images on the surface of a substrate as a plurality of toner layers, and fixing means for temporarily fixing the laminated plural toner layers.

The sixteenth aspect of the invention provides an image-recorded medium (C) produced by the method (A) for producing the image-recorded medium, wherein the fixed image formed by the plural toner layers is formed as a mirror image so that the fixed image is recognized as a normal image when viewed from the face opposed to the fixed image forming face of the substrate, the fixed image comprises a light screening portion and a light transmission portion, and the light screening portion has a transmission density of 3.5 or more.

The seventeenth aspect of the invention provides the image-recorded medium (C), wherein TMA in the light screening portion is in the range of 1.8 to 3.0 mg/cm$^2$.

The eighteenth aspect of the invention provides an image-recorded medium (D) produced by the method for producing the image-recorded medium, wherein the fixed image formed by the plural toner layers is formed as a mirror image so that the fixed image is recognized as a normal image when viewed from the face opposed to the fixed image forming face of the substrate, the fixed image comprises a light screening portion and a light transmission portion, and the light screening portion has a transmission density of 3.5 or more.

The nineteenth aspect of the invention provides the image-recorded medium (D), wherein TMA in the light screening portion is in the range of 1.8 to 3.0 mg/cm$^2$.

DETAILED DESCRIPTION OF THE INVENTION

The present invention will be described in detail hereinafter.

<Method for Producing the Image-Recorded Medium, and Image-Recorded Medium>

The invention provides a method for producing an image-recorded medium in which a fixed image is formed on a surface of a transparent substrate electrographically and the fixed image is laminated. The production method comprises:

laminating a plurality of toner layers on a surface of a substrate electrographically;

temporarily fixing the plural toner layers; and laminating the temporarily fixed image with a laminate film.

The fixing step in the method for forming the image-recorded medium recited in the invention comprises a primary fixing step of forming a temporarily fixed image constituted by a plurality of toner layers, and a secondary fixing step of converting the temporarily fixed image into a fixed image.

As described above, when the plural toner layers are temporarily fixed at a low temperature or fixed in plural steps, not in a single step at a high temperature as in a usual fixing, the toner layer can be efficiently degassed at the fixing, and air among the toner layers is not left as air bubbles in the fixed image; therefore, no blisters and voids are generated, so that an image-recorded medium excellent in the light screening property and light transmission property can be obtained.

Figure 1:
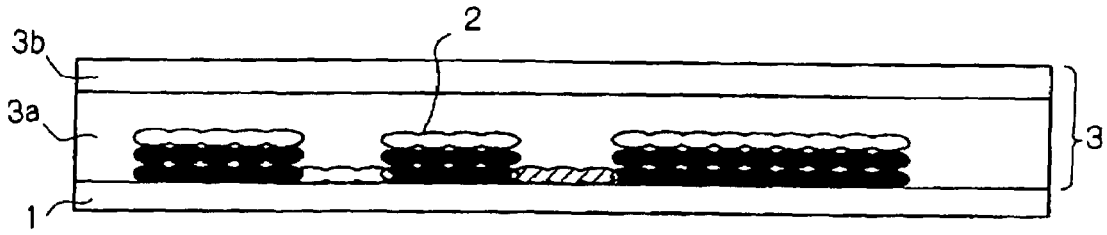
FIG. 1 is a cross section of the construction showing an example of the image-recorded medium of the present invention.

FIG. 1 is an enlarged cross section showing an example of the image-recorded medium produced by the method of the invention. As shown in FIG. 1, the image-recorded medium comprises Substrate 1, Fixed images 2 fixed thereon, and Laminate film 3 covering the fixed images 2.

The image-recorded medium of the invention is used in a manner in which Fixed image 2 is watched through Substrate 1 from Substrate 1 side in FIG. 1. Accordingly, in the invention, the toner layer (fixed image) is formed on the surface of Substrate 1 as a mirror image (an inverse image) so that Fixed image 2 is recognized as a normal image when seen from the face (the lower face in FIG. 1) of Substrate 1, which is the opposite face to the fixed image forming face, providing the image observed from the side where the toner image (fixed image) is formed in the conventional image-recorded medium is defined as a true image (a normal image).

Figure 2:
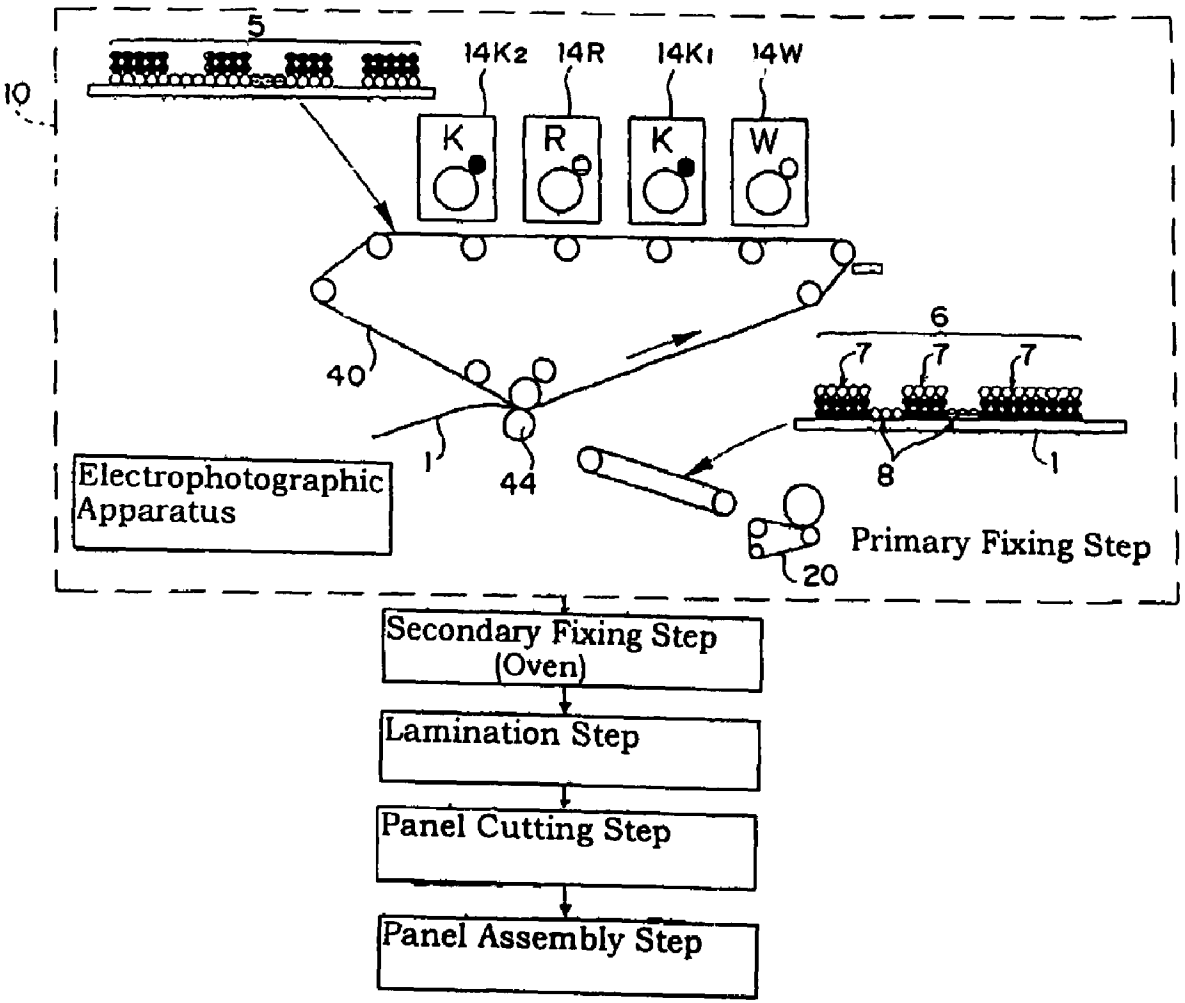
FIG. 2 is a schematic diagram illustrating the production steps for the image-recorded medium and display panel.

FIG. 2 shows the method for manufacturing the image-recorded medium of the invention, and a schematic flow chart of the steps of manufacturing a meter panel using the image-recorded medium.

A plurality of toner layers are formed on the surface of Substrate 1 (toner layer forming step) using Electrophotographic apparatus (image forming apparatus of the invention) 10, and the toner layers are subjected to the primary fixing with Fixing device 20. The toner layer may be subjected to the secondary fixing step by using an oven, for degassing the toner layers. Subsequently, the image-recorded medium is obtained by laminating the surface of the fixed image with a laminate film in a lamination step for protecting the surface of the fixed image as described above. The laminated image is formed into a panel member in a cutting step, and is finally used as parts for producing an automobile panel meter in a panel assembly step.

The invention will be described in more detail hereinafter following the method for producing the image-recorded medium according to the invention.

First Embodiment

The method for producing the image-recorded medium in the embodiment comprises the toner-layer forming step, fixing step and lamination step.

—Toner Layer Forming Step—

A plurality of toner layers are formed on the surface of Substrate 1 electrographically in the toner-layer formation step of the invention.

Substrate 1 available in the invention must be transparent. Since the image-recorded medium of the invention as, for example, an automobile panel meter is used in such a direction that the face of Substrate 1 having Fixing image 2 is further from observers, Fixed image 2 must be visible through Substrate 1.

"Transparent" as used herein means the property of transmitting a light in the visible region to a certain extent. And a substrate which is transparent to such a degree that when the substrate is used as Substrate 1, Fixed image 2 can be recognized by being watched through Substrate 1, can be used as the substrates in the invention.

Plastic films are typically used as Substrate 1. These include light transmitting films usable for OHP such as an acetate film, a cellulose triacetate film, nylon film, polyester film, polycarbonate film, polystyrene film, polyphenylene sulfide film, polypropylene film, polyimide film and cellophane. The polyester film is frequently used at present from general point of views including mechanical, electrical, physical and chemical properties and permissibility. A biaxially stretched polyethylene terephthalate (PET) film is frequently used among them.

A transparent resin and transparent ceramic may be used as Substrate 1 as well as the plastic films exemplified above. Pigments and dyes may be added therein. Substrate 1 may be a film or plate, and may be thick enough to lose its flexibility, or enough to have a strength required for Substrate 1.

Substrate 1 used in the invention is preferably a plastic film having a thickness in the range of 50 to 200 μm, and more preferably a PET film having a thickness in the range of 80 to 200 μm.

In the invention, a plurality of toner layers are laminated electrophotographically on the surface of Substrate 1 (in the invention, local existence of monolayer portion is permitted providing the toner layers are laminated in the image portion as a whole). The electrophotographic formation of toner layers is achieved by the following processes.

An example of the processes comprises: uniformly charging the surfaces of the electrophotographic photosensitive materials of the toner image forming parts 14W, 14K1, 14R and 14K2 disposed in Image forming apparatus 10 in FIG. 2; forming electrostatic latent images on the surfaces by exposing the surfaces to image-wise lights corresponding to image information feeding toner from a development device to the electrostatic latent images on the surfaces of the electrophotographic photosensitive materials to allow the electrostatic latent images to be developed to visible images by the toner to form a toner image; and transferring the formed toner images to Substrate 1 directly or via an intermediate transfer member, to form the plural toner layers. In the image forming apparatus 10 shown in FIG. 2, the toner images are sequentially transferred from the toner image forming parts 14W, 14K1, 14R and 14K2 onto the surface of Intermediate transfer member 40. The plural toner layers laminated on the surface of Intermediate transfer member 40 are transferred onto the surface of Substrate 1 at a secondary transfer part 44, and the plural toner layers which are inversions of the above toner layers are provided on the surface of Substrate 1.

Since the toner layers are formed necessarily as mirror images (inverse images) on the surface of Substrate 1 when the image-recorded medium of the invention is produced, electrostatic latent images are formed on the electrophotographic light sensitive material as mirror images. The mirror image toner layers are transferred and formed on the surface of Substrate 1 via Intermediate transfer member 40 after the latent images were developed as the toner images.

When a full-color image is formed, the development processes each for one of four colors of yellow, magenta, cyan and black are proceeded separately. Each color image is directly fixed on Substrate 1 by sequentially laminating the color toner images (toner layers) on Substrate 1, or is fixed on Substrate 1 after sequentially laminating the color toner images on the intermediate transfer member.

As in the automobile panel meter, the image-recorded medium of the invention is used in a manner in which a light is illuminated from the side of Substrate 1 on which Fixed image 2 is formed, and the portions where the light is transmitted are recognized as letters or images from the side opposed to the light illuminating side. Fixed image 2 should comprise a light screening portion which completely screens the light, and a light transmission portion that can be recognized as clear images with the illumination light.

Accordingly, the light screening portion is required to have a high light screening property (light non-transmitting property), and a certain amount of a black toner should be developed at this portion. However, since the amount of the toner having the color K that can be developed in a single development is restricted, a sufficient light impermeable property cannot be secured when the four colors toners of Y (yellow), C (cyan), M (magenta) and K (black) are used as described above. Accordingly, it is preferable to form the toner image comprising two K-color toner layers by developing the color K twice, instead of developing respective four colors of Y, C, M and K once, in order to secure the light screening property of the light non-transmitting portion (light screening portion) by forming a sufficient amount of color K toner layer on Substrate 1.

Since white color is often used in the image portion in the automobile display panel, the uppermost surface layer of the laminated plural toner layers should be a white toner layer in this case. Furthermore, reproducibility of the color viewed from the opposite side to the toner layers side of Substrate 1 may be improved by forming the uppermost surface layer with the white toner layer, while the light screening property is secured. Accordingly, it is preferable that the uppermost surface layer of the toner layer is a layer comprising the white toner, in order to ensure the light screening property when white color is used at the image portion.

Four toner image forming parts of W (white) 14W, K (black) 14K1, R (red) 14R and K (black) 14K2 colors are provided along Belt-shaped intermediate transfer member 40 in Image forming apparatus 10 in FIG. 2 considering the situations above. The primary transfer is repeated by allowing Intermediate transfer member 40 to move in the direction shown by the arrow, and Primary transfer images 5 are formed on the surface of Intermediate transfer member 40. Primary transfer image 5 is secondarily transferred on the surface of Substrate 1 by Secondary transfer part 40, and Secondary transfer images 6 are formed on the surface of Substrate 1.

Secondary transfer image 6 has the lamination order of the toner layers opposite to the lamination order of the toner layers in Primary transfer image 5. Portion 7 on which the toner layers are sequentially laminated in the order of K, K and W from the surface of Substrate 1 finally serves as a light screening portion, while Portion 8 on which one toner layer of W or R is formed on the surface of Substrate 1 finally serves as the light transmission portion (letter portion).

Figure 4:
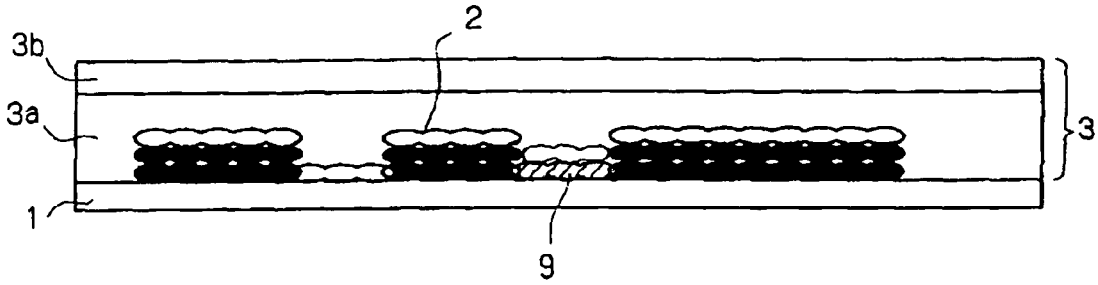
FIG. 4 is a cross section of the construction showing another example of the image-recorded medium of the invention.

As shown in the cross section of the construction of the image-recorded medium in FIG. 4, the light transmission portion may be Portion 9 where R and W are sequentially laminated from the surface of Substrate 1. This construction permits formation of a more uniform light transmission portion than that in the case shown in FIG. 1 in which the light transmission portion is composed of only the color R. The construction also provides an image-recorded medium having letter portions more excellent in uniformity and clearness may be formed. In other words, all the toner image (fixed image) of the invention may comprise the plural toner layers, or the toner image may partially comprise monolayer or bilayer portions. A variety of light screening portions and light transmission portions can be constructed by various constitutions of the toner layers.

Although in the invention, the plural toner layers are laminated in the order of lamination (the order of transfer) of W, K, R and K by using each development cartridge, the order of the three cartridges except the cartridge W can be arbitrarily selected so long as the cartridge W is placed at the first by the reasons as described above.

The method for forming the toner layers electrophotographically is not particularly restricted, and methods, production processes, apparatus and means known in the art as the electrophotographic techniques may be employed without any problems.

The electrophotographic toner used in the invention comprises a binding resin and coloring agent as main components.

Examples of the binding resin used for the toner include homopolymers or copolymers of:

styrenes such as styrene and chlorostyrene;

monoolefins such as ethylene, propylene, butylene and isobutylene; vinyl esters such as vinyl acetate, vinyl propionate, vinyl benzoate and vinyl acetate;

α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate;

vinyl ethers such as vinylmethyl ether, vinylethyl ether and vinylbutyl ether; and vinyl ketones such as vinylmethyl ketone, vinylhexyl ketone and vinylisopropenyl ketone. Examples of the representative binding resins include polystyrene, styrene-acrylic ester copolymers, styrene-methacrylic ester acid copolymers, styrene-acrylonitrile copolymers, styrene-butadiene copolymers, styrene-maleic anhydride copolymers, polyethylene and polypropylene.

Additional examples of the binding resin include polyester, polyurethane, epoxy resins, silicone resins, polyamide, modified rosins, paraffin and wax. Polyester is particularly suitable as the binding resin among the resins above. The polyester resin used in the invention is synthesized by polycondensation of a polyol component and an acid component. Examples of the polyol component include ethyleneglycol, propyleneglycol, 1,3-butanediol, 1,4-butanediol, 2,3-butanediol, diethylene glycol, triethylene glycol, 1,5-butanediol, 1,6-hexanediol, neopentyl glycol, cyclohexane dimethanol, bisphenol A/ethylene oxide adducts, and bisphenol A/propylene oxide adducts.

Examples of the acid component include maleic acid, fumaric acid, phthalic acid, isophthalic acid, terephthalic acid, succinic acid, dodecenyl succinic acid, trimellitic acid, pyrromellitic acid, cyclohexane tricarboxylic acid, 1,5-cyclohexane dicarboxylic acid, 2,5,7-naphthalene tricarboxylic acid, 1,2,4-naphthalene tricarboxylic acid, 1,2,5-hexane tricarboxylic acid and 1,3-dicarboxyl-2-methylenecarboxypropane tetramethylene carboxylic acid, and anhydrides thereof. A plurality of resins selected from the resins above may be blended.

While representative examples of the representative coloring agents include carbon black as a black coloring agent; C.I. pigment red 48:1, C.I. pigment red 122, and C.I. pigment red 57:1 as magenta coloring agents; C.I. pigment yellow 97, C.I. pigment yellow 12, and C.I. pigment yellow 180 as yellow coloring agents; and C.I. pigment blue 15:1 and C.I. pigment blue 15:3 as cyan coloring agents, the coloring agents are not restricted thereto.

Coloring agents used for the magenta color and yellow color may be appropriately mixed for use as the red toner.

While the examples of the white coloring agent include titanium oxide, silica, tin oxide, aluminum oxide and magnesium oxide, titanium oxide is preferable from the viewpoint of the light resistance. While rutile type, anatase type and brookite type titanium oxides are known as titanium oxide, rutile type titanium oxide is preferable from the viewpoint of the screening property. The surface of titanium oxide is preferably surface-treated with alumina or silica in order to improve the light resistance.

The red and white toners used in the image portion (light transmission portion) is required to be transparent to a certain extent for display by back-light illumination, and this portion is required to have a transmission density of 0.1 to 1, preferably 0.3 to 0.7. Accordingly, the content of the coloring agent in the toner is preferably in the range of 4 to 40% by mass, more preferably in the range of 6 to 35% by mass. The transferred mass per area (TMA) of the toner on the surface of Substrate 1 at the light transmission portion is preferably in the range of 0.3 to 1.0 mg/cm$^2$ per one toner layer, and more preferably, 0.4 to 0.9 mg/cm$^2$.

On the other hand, the black toner used in the background portion (light screening portion) is required to have a light screening property with a transmission density of 3.5 or more. The content of carbon black as the coloring agent may be increased, or TMA of the black toner may be increased for increasing the transmission density. However, since carbon black is conductive, the electrical resistance of the toner decreases when the content of carbon black in the toner is too high, to cause fogging and scattering of the toner due to decreased electrification of the toner.

The transmission density of the light screening portion is preferably 3.8 or more, more preferably 4.0 or more.

Since the resistance of the developer decreases, the carrier itself is also developed to cause Bead Carry Over (BCO). When TMA is too high, on the other hand, the image is poorly transferred to Substrate 1 to generate uneven images. Accordingly, the content of carbon black is in the range of 4 to 15% by mass, and TMA of the black toner is preferably in the range of 1.2 to 2.0 mg/cm$^2$, for satisfying a transmission density of 3.5 or more without causing fogging, scattering of the toner, BCO and uneven images. TMA of the light screening portion is preferably in the range of 1.8 to 3.0 mg/cm$^2$, and more preferably, 2.1 to 2.7 mg/cm$^2$.

The electrophotographic toner used in the invention may contain additives such as an electrification control agent and wax, if desired. Examples of the electrification control agent include azo base metal complexes, and metal complexes or metal salts of salicylic acid or alkylsalicylic acid. The waxes usable include olefin waxes such as low molecular weight polyethylene and low molecular weight polypropylene, plant waxes such as carnaubau, animal waxes and inorganic waxes.

While the method for producing the electrophotographic toner used in the invention is not particularly restricted, for example, a melt-pulverization method is preferable. According to the melt-pulverization method, various toner materials as described above are mixed with a Banbury mixer, Nyder coater, continuous mixer and extruder, and melt-kneaded, pulverized and classified to produce toner. The volume average particle diameter of the toner is 30 μm or less, preferably in the range of 4 to 20 μm.

A fluidizing agent may be further added in the electrophotographic toner used in the invention as a separate component. Examples of the fluidizing agent include silica, titanium oxide and aluminum oxide.

The electrophotographic toner used in the invention may be used as a two-component developer by mixing with an appropriate carrier. Any carrier known in the art may be used. For example, the carriers usable include ferrite, magnetite and iron powders, and the surface thereof may be coated with a resin such as a styrene resin, fluorinated resin, silicone resin or epoxy resin. It is possible to use the carrier as a semiconductive or conductive carrier by adding a conductive powder such as carbon black or a metal oxide powder based conductive powder to the coating resin. The volume average particle diameter of the carrier is usually adjusted in the range of 20 to 100 μm.

The mass mixing ratio of the toner in the two-component developer controls the amount of electrification of the toner, determines the upper limit of the amount of the developing toner, and is an important factor that determines TMA. The mixing ratio is adjusted in the range of 2 to 12% by mass in the invention. Desired TMA cannot be easily obtained when the mixing ratio is smaller than 2% by mass, since the amount of electrification becomes too high or the upper limit of the amount of the developing toner becomes small. Fogging and scattering of the toner are sometimes easily occur when the mixing ratio is larger than 12% by mass since the electrification quantity is too low.

—Fixing Step—

The plural toner layers (Secondary transfer images 6) formed on the surface of Substrate 1 are temporarily fixed on the surface of Substrate 1. Specifically, among the toner layers of Secondary transfer image 6 formed on the surface of Substrate 1, only the toner layer in the vicinity of the upper most layer is temporarily fixed with Fixing device 20 for preventing the blisters from being generated at the time of fixing, in the process for producing the image-recorded medium of the invention.

In the fixing step of Secondary transfer image 6 formed on the surface of Substrate 1, the toner layer constituting Secondary transfer image 6 is fixed, for example, by heat-fusion with Fixing device 20 integrated in Image forming apparatus 10. Either a roll fixing apparatus or belt fixing apparatus may be used for fixing.

Only the toner at the uppermost layer of the secondary transfer image 6 is temporality fixed to an extent not to cause image slippage, in order to avoid blisters from being generated in the fixing step. For this purpose, fixing temperature T1 is preferably a temperature at which the uppermost layer of the plural toner layers is melted, and the temperature is preferably in the range of 100 to 140° C. The fixing temperature means the surface temperature of a fixing member such as the fixing roll.

—Lamination Step—

When Substrate 1 on which Fixed image 2 is formed is used, for example, for the automobile meter panel, Fixed image 2 is fluidized by the temperature in the cabin that may be increased up to about 80 to 100° C. Consequently, Fixed image 2 is laminated with transparent Laminate film 3 in the lamination step for protecting Fixed image 2.

In the lamination step, transparent Laminate film 3 is laminated by contact bonding on the surface of Substrate 1 on which Fixed image 2 is formed.

Laminate film 3 usable includes the same material as Substrate 1. Vinyl chloride film, vinylidene chloride film, and polyester film can also be used.

It is preferable to provide Adhesive layer 3*b* on the face of Laminate sheet 3*a* which will contact with Fixed image 2 as shown in FIG. 1, wherein Adhesive layer 3*b* is composed of the material above, for improving the contact characteristics between Laminate film 3 and both of Fixed image 2 and Substrate 1.

Examples of the adhesive used for Adhesive layer 3*b* include polyester based adhesives, isocyanate based adhesives, vinylether polymer adhesives, polyisobutylene adhesives, and polyisoprene adhesives. Conventionally employed methods such as blade coating method, wire-bar coating method, spray coating method, dip coating method, beads coating method, air-knife coating method, curtain coating method and roll coating method may be employed for coating the adhesive on the surface of the laminate film.

The thickness of the laminate sheet 3*a* is selected in the range of 10 to 200 μm, more preferably in the range of 25 to 75 μm, considering heat fusion ability, handling ability and strength. The thickness of the adhesive layer 3*b* is preferably in the range of 10 to 100 μm, more preferably in the range of 20 to 50 μm, considering the height of the toner layer.

Second Embodiment

While the method for producing the image-recorded medium in this embodiment comprises the step of toner layers formation, step of fixing and step of lamination similarly to the first embodiment, the fixing step comprises the primary fixing step of temporarily fixing the plural toner layers and the secondary fixing step of fixing the temporarily fixed image. The other steps are the same as those in the first embodiment.

The primary fixing step is the same as the fixing step in the first embodiment. The second fixing step in this embodiment is conducted for degassing the air remaining in the toner layer after the temporary fixing step conducted in the first embodiment. This step enables more efficient suppression of voids in a high temperature environment.

The secondary fixing step is conducted by melting the images temporarily fixed in the primary fixing step. According to the invention, the secondary fixing step is preferably conducted in a non-contact manner such as heating in an oven, in order to prevent deterioration of the image quality caused by deformation of the toner image caused by contact with fixing members.

The temperature T2 at the second fixing step is preferably a temperature at which the entire toner layers are melt, and is preferably in the range of 100 to 170° C. The time period of the secondary fixing step is preferably in the range of 1 to 60 minutes.

The secondary fixing temperature T2 refers to as the temperature in the oven, when the secondary fixing step is applied in the oven as described above.

According to the method for producing the image-recorded medium of the invention as described above, generation of pin-holes and voids can be prevented when the image-recorded medium of the invention is used, for example, for the automobile meter panel. The invention provides a method for producing an image-recorded medium capable of maintaining highly reliable recorded images.

<Image Forming Apparatus>

The image forming apparatus of the invention is used for the method for producing an image-recorded medium, and comprises development means that forms a plurality of toner images in accordance with image information, transfer means that laminates the plural toner images on the surface of the substrate as a plurality of toner layers, and fixing means that temporarily fixes the laminated toner layers.

Figure 3:
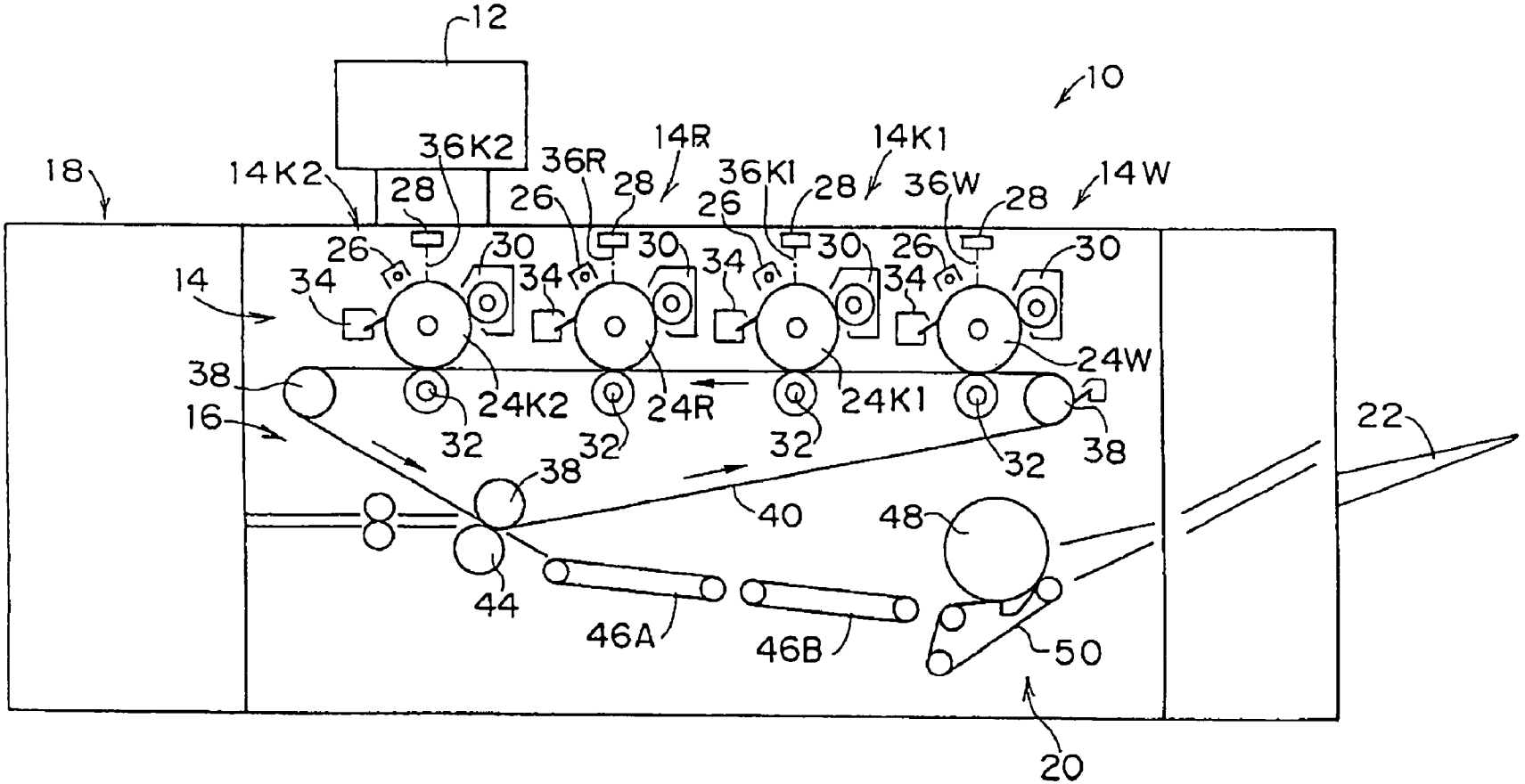
FIG. 3 is a schematic cross section showing an example of the construction of the image forming apparatus of the invention.

FIG. 3 shows a cross section of the construction of Image forming apparatus 10 in FIG. 2 which explains the construction more specifically.

Image forming apparatus 10 according to the invention comprises, as shown in FIG. 3 as an example, Image processor 12 that receives image information and controls the movement of each part, Toner image forming part 14 (development device)that forms respective color toner images by driving signals from Image processor 12, Transfer part 16 (transfer means) that transfers the toner image on the surface of the substrate to be described hereinafter, Feeder 18 that feeds the substrate to a transporting passageway, Fixing part 20 (fixing device) that fixes the toner image on the substrate, and Tray 22 to which the substrate bearing the image is discharged.

In the method for producing the image-recorded medium according to the invention, as described above, the development means and transfer means are used in the toner layers formation step, and the fixing means is used in the primary fixing step.

Toner image forming part 14 comprises the toner image forming parts 14W, 14K1, 14R and 14K2 (referred to as 14W to 14K2 hereinafter; the same type of ellipsis is also used for other reference numerals) for forming white (W), black (K1), red (R) and black (K2) toner images, respectively.

Two black recording colors are provided because, since the electrophotography is usually constructed on the premise that the light is transmitted, a plurality of toner image forming parts should be used when a lot of black toner is necessary for forming portions that do not transmit the light (light non-transmitting portion=thick black toner layer) such as the meter panel.

Although the colors used for this meter panel are white and red, different recording colors may be used in other cases. The transfers onto the surface of Intermediate transfer belt (intermediate transfer member) 40 preferably has the order of white, black, red and black when the white and red colors are used as the other recording colors.

Toner image forming parts 14W to 14K2 comprise Electrifier 26, Light scanning device 28, Development device 30, Primary transfer member 32 and Toner removing blade 34 disposed around respective Photosensitive drums (electrophotographic photosensitive members) 14W to 14K2. In other words, Photosensitive drums 24W to 24K2 are electrified by being rotated in the clockwise direction as shown in FIG. 3 to form electrostatic latent images by scanning with Laser beams 36W to 36K2 of Light scanner 28, and toner images having colors corresponding to respective image signals are formed at the portions on which electrostatic latent images has been formed with Development device 30.

The developers (toners) used in Toner image forming parts 14K1 and 14K2 may be the same with or different from each other.

Transfer part 16 is wound around Three rollers 38, and comprises Intermediate transfer belt 40 disposed such that Intermediate transfer belt 40 can rotate in the counterclockwise direction as shown in FIG. 2, Primary transfer part 32 that transfers the toner image formed on the surface of Photosensitive drums 24W to 24K2 onto Intermediate transfer belt 40 by compressing Intermediate transfer belt 40 onto Photosensitive drums 24W to 24K2, and Secondary transfer part 44 that transfers the toner image which has been transferred and laminated on the surface of Intermediate transfer belt 40 onto Substrate 1.

Since the TMA in the secondary transfer process as well as the resistance of Substrate 1 are high in the image forming apparatus of the invention, it is preferable to set the transfer bias at Secondary transfer member (secondary transfer roll) 44 at a value higher than the conventional transfer bias. The transfer bias is preferably in the range of 1,600 to 3,500 V, more preferably in the range of 1,900 to 3,000.

When the secondary transfer bias is less than 1,600 V, the toner may be not so sufficiently transferred from Intermediate transfer member 40. When the bias exceeds 3,500 V, on the other hand, re-transfer of the toner occurs to cause generation of pin-holes.

The transportation system for Substrate 1 is constructed so that Substrate 1 is transported from Feeder 18 to Tray 22 via Secondary transfer member 44 and Fixing part 20, and discharged from Tray 22.

Fixing part 20 comprises Heat drum 48 and Compression belt 50 that contact-bonds Substrate 1 to Heat drums 48, in order to fix the transferred toner images (plural toner layers) on Substrate 1. The surface temperature of Heat drums 48 is preferably in the range of 100 to 140° C. from the viewpoint of temporarily fixing the toner as described above.

Since Substrate 1 used for the image forming apparatus of the invention serves as a substrate for forming the meter panel, the substrate should have a prescribed strength and transparency for allowing the light to be transmitted.

Slow-down convey belts 46A and 46B are provided between Secondary transfer part 44 and Fixing part 20 for decreasing the transportation speed of Substrate 1 in two steps in order to adjust the difference of processing speed between Secondary transfer part 44 and Fixing part 20.

The toner layer forming step and primary fixing step are performed using the image forming apparatus of the invention, and the image-recorded medium that can be used for producing automobile meter panels is produced thereafter via the secondary fixing step and lamination step.

EXAMPLES

While the present invention is described in detail with reference to examples, the invention is by no means restricted to these examples.

Example 1

<Production of Substrate>

—Preparation of Glossiness Control Layer Coating Solution—

Into 100 parts by mass of butyl alcohol, 10 parts by mass of polyvinyl butyral (BM-S made by Sekisui Chemical Co., Ltd.) as a heat-meltable resin, 15 parts by mass of polymethyl methacrylate fine particles (MP-1451 made by Soken Chemical & Engineering Co., Ltd., volume average particle diameter: 0.1 μm) as a filler, and 0.5 parts by mass of a charge control agent (Elegan 264 WAX made by Nippon Oil & Fats Co., Ltd.) were added, and the mixture was thoroughly mixed with a homo-mixer to prepare a glossiness control layer coating solution A.

—Preparation of Image Receiving Layer Coating Solution—

The image receiving layer coating solution B having the same composition as in glossiness control layer coating solution A, except that the filler was removed from glossiness control layer coating solution A, and 0.05 parts by mass of cross-linked polymethyl methacrylate (MP-150 made by Soken Chemical & Engineering Co., Ltd., volume average particle diameter: 5 μm) was added as a matting agent.

—Production of Substrate—

Glossiness control layer coating solution A was coated on a PET film (Lumilar 125T60 made by Panac Co.) with a thickness of 125 μm in an amount of 30 g/m$^2$. The film was dried at 130° C. for 10 minutes to form a glossiness control layer with a thickness of 2 μm. Image receiving layer coating solution B was applied on the surface opposed to the surface on which the glossiness control layer was formed to form an image receiving layer with a thickness of 2 μm, thereby producing the substrate used in the invention.

<Production of Image-Recorded Medium>

An image was formed on the substrate by using Color DOCUTECH® 60 (manufactured by Fuji Xerox Co., Ltd.), which is an electrophotographic image forming apparatus. Image information of the image formed was the automobile meter panel having a high-light portion for an warning lamp portion and light screening portion for the other portions.

Specifically, the toner colors used for the four development units (toner image forming parts) in the image forming apparatus were determined to be W, K, R and K in the order of primary transfer. The toner layers were formed so that the toner layers were laminated on the surface of the substrate shown in FIG. 4 in the high-light portion (light transmission portion) corresponds to Letter portion 9 in the order of R and W, and the toner layers were laminated on the surface of the substrate in the other portions correspond to the light screening portions in the order of K, K and W. The toner layers were temporarily fixed thereafter at a fixing temperature of 140° C. of the fixing device.

TMA of the laminated toner layer before the fixing was 2.3 mg/cm$^2$ in the light screening portion, and 1.2 mg/cm$^2$ in the light transmission portion.

The substrate on which the primary fixed image was formed by the image forming apparatus was placed in an oven, and the primary fixed image was fixed by the secondary fixing at 110° C. for 30 minutes.

On the other hand, a laminate film was prepared by coating a vinylether polymer on one surface of a transparent laminate sheet (material: polyethylene terephthalate (PET), A4 size, thickness: 80 μm) as an adhesive layer with a thickness of 30 μm, and the film was stacked on the substrate so that the surface of the adhesive layer faces the surface of the support on which the fixed image was formed. The laminated film was passed through a nip between a pair of heated rolls heated at 100° C. using a heated-roll laminator to produce an image-recorded medium.

The transmission densities of the image-recorded medium obtained were 3.8 in the light screening portion, and 0.8 in the light transmission portion. The image quality was excellent without inferior graininess and image defects such as visible dots. The transmission density was measured by using a transmission densitometer made by X-Rite Incorporated.

<Evaluation of the Image-Recorded Medium>

The image-recorded medium prepared as described above was set on a light table, and illuminated with a fluorescent lamp from the rear side which is the laminated side of the image-recorded medium. No pin-holes transmitting the light of the fluorescent lamp were observed with the naked eye.

The image-recorded medium was placed in the oven again, and was subjected to an endurance test corresponding to several years at an automobile cabin temperature of 80 to 100° C., which is a supposed condition at midsummer. The image-recorded medium after the endurance test was also evaluated in the same manner as described above. As the result, no voids that transmit the light of the fluorescent lamp were found as well, and good images were maintained.

The invention provides a method for producing an image-recorded medium having highly reliable recorded images without any deterioration in a high temperature environment and an image forming apparatus used for the method, and an image-recorded medium produced by the method and the apparatus, wherein the image-recorded medium is required to have both characteristics of light screening property and light transmittance property as in the case of automobile meter panels.

What is claimed is:

1. A method for producing an image-recorded medium on the surface of a transparent substrate, the image-recorded medium comprising a fixed image formed electrographically, and the fixed image being laminated on the image-recorded medium, the method comprising: forming toner layers by laminating a plurality of toner layers on the surface of the substrate electrographically; temporarily fixing the plural toner layers; and laminating the temporarily fixed image with a laminate film, wherein a fixing temperature T1 in the fixing step is in the range of 100 to 140° C.

2. A method for producing the image-recorded medium according to claim 1, wherein a toner layer having a color K (black) is developed twice in forming the toner layers.

3. A method for producing the image-recorded medium according to claim 1, wherein a white toner layer is formed at the uppermost layer of the laminated plural toner layers in forming the toner layers.

4. A method for producing the image-recorded medium according to claim 1, wherein a developer used in the step for forming the toner layers includes a toner and carrier, and the proportion of the mass of the toner to the sum of the mass of the toner and mass of the carrier is in the range of 2 to 12%.

5. A method for producing the image-recorded medium according to claim 1, further comprising degassing the toner layers during the temporarily fixing prior to laminating the temporarily fixed image.

6. A method for producing an image-recorded medium on the surface of a transparent substrate, the image-recorded medium comprising a fixed image formed electrographically, and the fixed image being laminated on the image-recorded medium, the method comprising: forming toner layers by laminating a plurality of toner layers on the surface of the substrate electrographically; temporarily fixing the plural toner layers by primary fixing, and converting the temporarily fixed image to a fixed image by secondary fixing; and laminating the fixed image with a laminate film, wherein a fixing temperature T1 in the primary fixing is in the range of 100 to 140° C.

7. A method for producing an image-recorded medium according to claim 6, wherein a toner layer having a color K (black) is developed twice in forming the toner layers.

8. A method for producing the image-recorded medium according to claim 6, wherein a white toner layer is formed at the uppermost layer of the laminated plural toner layers in forming the toner layers.

9. A method for producing the image-recorded medium according to claim 6, wherein the developer used in the step for forming the toner layers includes a toner and carrier, and the proportion of the mass of the toner to the sum of the mass of the toner and mass of the carrier is in the range of 2 to 12%.

10. A method for producing the image-recorded medium according to claim 6, wherein the fixing temperature T2 in the secondary fixing is in the range of 100 to 170° C.

11. A method for producing the image-recorded medium according to claim 6, wherein the secondary fixing is carried out for 1 to 60 minutes.

12. A method for producing the image-recorded medium according to claim 6, wherein the secondary fixing is carried out in a non-contact state.

13. A method for producing the image-recorded medium according to claim 6, further comprising degassing the toner layers during the secondary fixing prior to laminating the fixed image.

14. A method for producing an image-recorded medium according to claim 13, wherein the toner layers are degassed using an oven.

* * * * *